United States Patent [19]

Hammond et al.

[11] Patent Number: 4,533,853

[45] Date of Patent: Aug. 6, 1985

[54] MECHANISM AND METHOD FOR CONTROLLING THE TEMPERATURE AND OUTPUT OF A FLUORESCENT LAMP

[75] Inventors: Thomas J. Hammond, Penfield; William L. Lama, Webster; Karl A. Northrup; Stephen C. Corona, both of Rochester, all of N.Y.

[73] Assignee: Xerox Corporation, Stamford, Conn.

[21] Appl. No.: 478,745

[22] Filed: Mar. 25, 1983

[51] Int. Cl.[3] ..... H01J 7/24; H01J 13/32; H01J 19/74; H01J 61/52

[52] U.S. Cl. ..... 315/117; 315/115; 315/116; 315/151; 250/205

[58] Field of Search ..... 315/112, 113, 114, 115, 315/116, 117, 149, 150, 158; 250/205

[56] References Cited

U.S. PATENT DOCUMENTS

| | | | |
|---|---|---|---|
| 3,192,724 | 7/1965 | Cummings | 62/3 |
| 3,309,565 | 3/1967 | Clark et al. | 315/117 |
| 3,336,502 | 8/1967 | Gilliatt | 315/108 |
| 3,359,454 | 12/1967 | Scheppe | 315/117 |
| 3,457,454 | 7/1969 | Boland | 315/115 |
| 3,686,529 | 8/1972 | Boland | 315/115 |
| 4,005,332 | 1/1977 | Gallo et al. | 315/112 |
| 4,101,807 | 7/1978 | Hill | 315/116 |
| 4,146,819 | 3/1979 | Hunter | 315/117 |
| 4,283,658 | 8/1981 | Parker | 315/117 |
| 4,431,947 | 2/1984 | Ferriss et al. | 315/117 |

FOREIGN PATENT DOCUMENTS

| | | | |
|---|---|---|---|
| 578244 | 6/1959 | Canada | 315/117 |

*Primary Examiner*—Saxfield Chatmon

[57] ABSTRACT

The light output of a fluorescent lamp is controlled and optimized. Both the light output and the lamp voltage peak at nearly the same value of mercury cold spot temperature. Controlling the lamp voltage therefore controls the light output. Thus, when the lamp voltage is continually monitored, any decline from the peak voltage is detected and a signal is generated which reverses the instant mode of operation of a cooling device placed in proximity to the lamp cold spot. With the cooling mode reversed, the lamp voltage will rise towards the peak. The cooling mode remains unaltered until the lamp voltage falls again.

4 Claims, 4 Drawing Figures

MECHANISM AND METHOD FOR CONTROLLING THE TEMPERATURE AND OUTPUT OF A FLUORESCENT LAMP

BACKGROUND

This invention relates to mercury vapor fluorescent lamps and particularly to a method for maintaining the mercury pressure within the lamp at an optimum value by monitoring and controlling the lamp output voltage.

In a mercury fluorescent lamp, an electrical discharge is generated in mercury vapor at low pressure and typically mixed with argon gas. The light output from the lamp depends, amoung other variables, on the mercury vapor pressure inside the lamp tube. The primary radiation from the mercury is at 2537 Angstroms and arises from the transition between the lowest nonmetastable excited state and the ground state. This ultraviolet radiation at 2537 Angstroms excites a phosphor which is coated inside the tube walls. The excited phosphor thereupon emits radiation at some wavelength, in the visible spectrum, characteristic of the phosphor.

It is known in the prior art that the optimum mercury pressure for maximum light output of a fluorescent lamp in alternating current operation is approximately 7 mtorr (independent of current) which corresponds to a mercury cold spot temperature of approximately 42° C. At this temperature and pressure, the light output increases monotonically with the current. At cold spot temperatures higher or lower than the optimum, light output falls off.

It is therefore desirable to maintain the mercury pressure at the optimum at any lamp current and at any ambient temperature. Prior art techniques for accomplishing this function required a temperature-sensitive device such as a thermocouple, thermistor or thermostat to monitor the temperature of the cold spot. A feedback circuit provided closed loop control of a temperature-regulating device to maintain the optimum mercury pressure. These methods, although providing a closed loop control of the cold spot temperature, must rely on a consistent relationship of cold spot temperature to light output which may not exist under all conditions.

The present invention is directed to a novel method for maintaining optimum mercury pressure which does not require the use of cold spot temperature measuring devices. As will be demonstrated in the suceeding descriptive portion of the specification, if lamp current is kept constant, the lamp arc voltage (voltage drop across the lamp) is a function of the mercury cold spot temperature. This voltage perks at approximately the same cold spot temperature as does the light output. According to one aspect of the invention, the lamp voltage is continually monitored by a circuit which is adapted to feed back a signal to a cold spot temperature-regulating device under certain condition. The circuit responds to any reduction in the voltage by reversing the operating mode of the temperature-regulating device. Thus, if the device has been off it is turned on and if on, it is turned off. Either action has the effect of restoring the output voltage to its peak level, and hence restoring the optimum mercury pressure.

A prime advantage of the method of the invention is that once the distribution and feedback circuits are designed with the appropriate algorithm, the system does not require any absolute calibration; that is, the peak voltage for a particular lamp does not need to be determined. Further, the feedback circuit is extremely fast relative to the prior art feedback loop which required a longer response time due to the thermal mass of the mercury pool heat sink, the glass envelope and the temperature sensitive device.

The present invention is therefore directed to a monitoring and control mechanism for optimizing the light output of a fluorescent lamp containing an excess of mercury at a cold spot therein, said mechanism comprising;

a power supply for applying operating current to said lamp, temperature control means adapted to operate in a first mode whereby temperature at said cold spot is increasing and in a second mode whereby temperature at said cold spot is decreasing, and a monitoring means for detecting a drop in the arc voltage of said lamp, said monitoring means adapted to transmit a signal to said temperature control means changing the instant mode of operation.

DRAWINGS

DESCRIPTION

Figure 1:
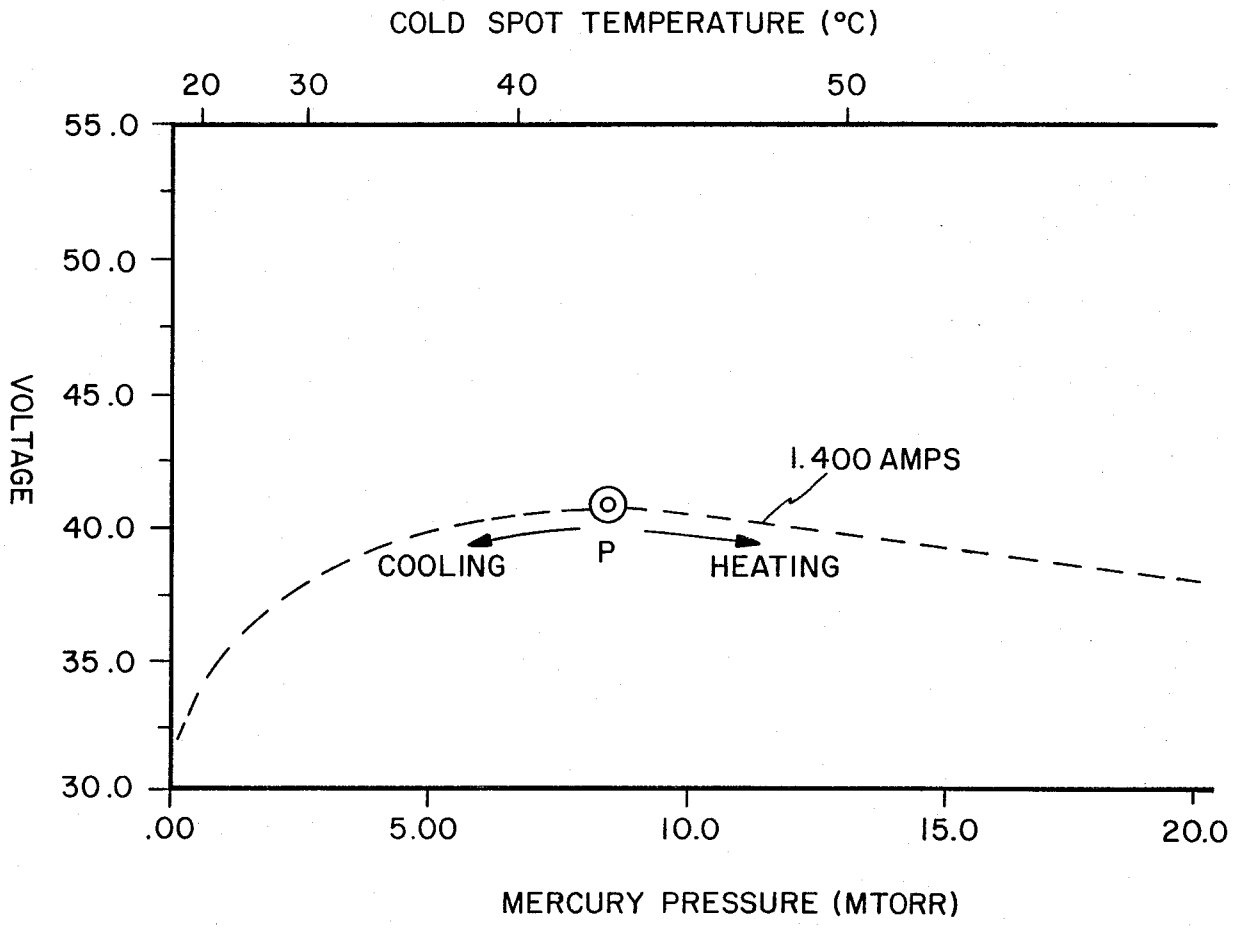
FIG. 1 is a graph plotting fluorescent lamp arc voltage against mercury cold spot temperature and pressure.

If the current through a mercury fluorescent lamp is kept constant, the voltage drop across the lamp (lamp arc voltage) is a function of the lamp mercury pressure. FIG. 1 is a graph illustrating the relation between lamp voltage, mercury pressure and mercury cold spot temperature at constant current. The graph was prepared using a T8, 22 inch long fluorescent lamp operated at a current of 1.4 amps. As shown, there is a point P at which the voltage is a maximum. Point P corresponds to the optimum mercury pressure of 7 mtorr at 42° C. which in turn corresponds to the optimum operating efficiency of the lamp at that current. Thus the light output and the voltage are at a maximum (peak) at the same cold spot temperature. Controlling the lamp voltage by maintaining proper cold spot temperature thus assures that the light output will be constant. The mercury vapor pressure, being dependent upon temperature, will very above or below the optimum during lamp operation; depending on the temperature variation as affected by the instant mode of operation of the temperature regulating device (e.g. a cooling fan or thermoelectric device). As is evident in FIG. 1, the lamp voltage will move away from its peak point P with either a rise or a fall in the cold spot temperature. According to one aspect of the invention the voltage is monitored by a circuit which detects any change (reduction) from the peak voltage. The circuit then generates a signal which reverses the operating mode of the particular temperature regulating device resulting in a reversal of the particular direction of the temperature change and a restoral of the optimum pressure, peak voltage and peak light output. As an example, if a cooling fan is being used to direct a flow of air against the mercury cold spot, and if the fan is in the inoperative (off) position, the cold spot temperature will tend to rise above the optimum. The output voltage will then decrease towards the right in the FIG. 1 plot. This decrease will be detected by the monitoring circuit and a signal will be generated and sent to the fan, via a control circuit, reversing the previous operational mode; that is, the fan will be turned on. The effect of the cooling will tend to decrease the cold spot temperature and return the pressure, voltage and light output to their optimum points. If the system establishes equilbrium at the optimum operating point, the monitoring circuit remains inactive. If however, the temperature again drops below the optimum, the circuit again detects a decrease from the optimum voltage and generates a signal to again reverse operation of the fan. In this case the fan will be turned off, allowing the temperature to rise towards the optimum. It does not matter in which direction the voltage is decreasing since the output signal to the temperature regulating means will always have the effect of selecting the operating mode appropriate to a restoration of the optimum operating level.

The above described technique requires the generation of a single algorithm to differentiate as to the conditions where the output voltage is below optimum but is moving back towards the optimum (function is improving) as opposed to the condition where the output voltage is below the optimum and is receding (function not improving). Using the example of a fan directing air against the cold spot, if the voltage is increasing in magnitude and the fan is off, the algorithm will be able to recognize that the lamp has not yet reached peak temperature and the fan should therefore remain off. The algorithm only responds to *decreases* in the lamp voltage. If however, the voltage was decreasing and the fan was off, the algorithm will recognize that the fan needed to be turned on to lower the temperature. The algorithm may also incorporate time delays that allow the lamp a chance to respond to the new cooling change. An example of a suitable algorithm is provide below.

Figure 2:
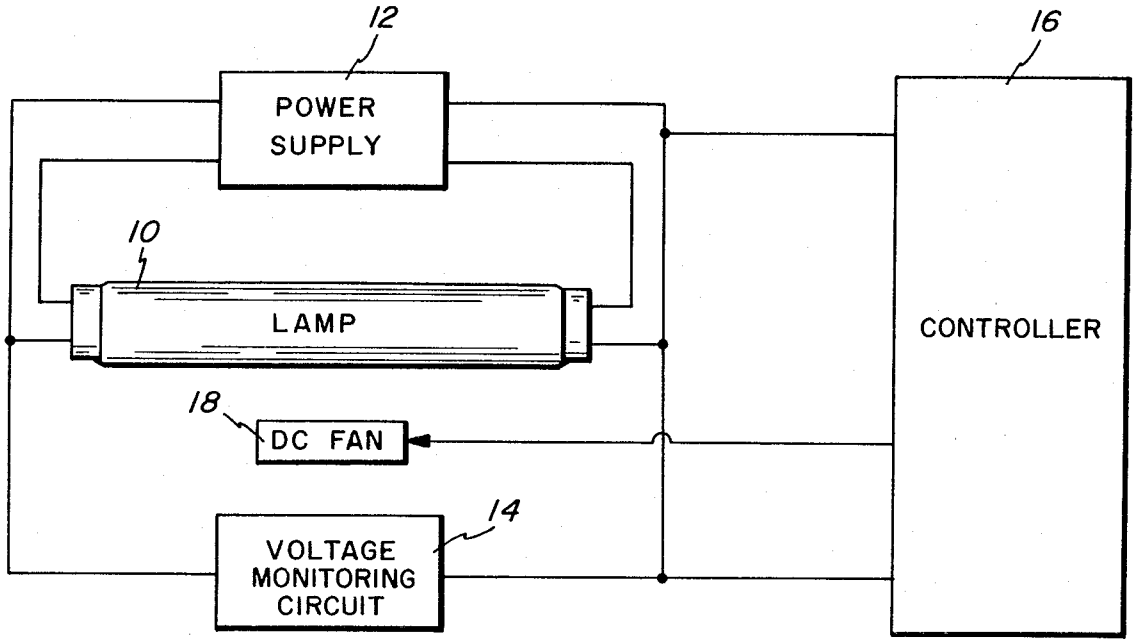
FIG. 2 is a schematic diagram of a circuit including a voltage monitoring circuit and a controller which implement the output control techniques of the present invention.
Figure 3:
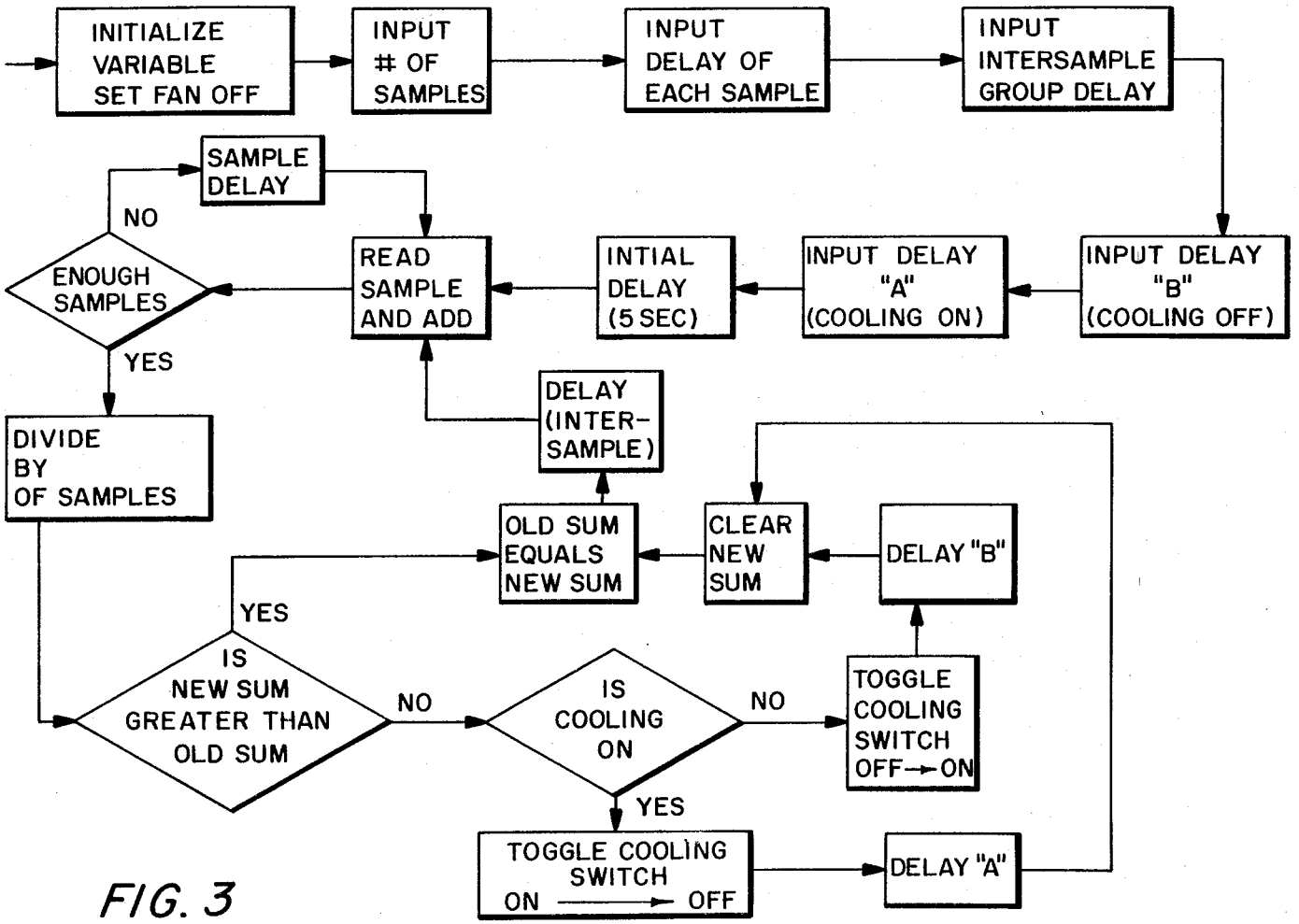
FIG. 3 is a program flow diagram of the controller shown in FIG. 2.

FIG. 2 is a block diagram of a circuit set-up to implement the monitoring technique broadly disclosed in above. Lamp 10 is a T8, 22" fluorescent lamp operated at 1.2 amps with a high frequency (29 Khz) power supply 12. A voltage monitoring circuit 14, monitors the lamp arc voltage and generates a signal sent to control 16. Fan 18 is dc-operated and placed near the center of the lamp and about 4" away to provide mercury cold spot cooling when it is turned on. Contoller 18 is a microprocessor based controller which received output voltage information from circuit 14. The controller is programmed to control the operation of fan 12 so as to maintain cold spot temperature and pressure at optimum. FIG. 3 is the algorithm flow diagram for this program. As shown in FIG. 3, the algorithm contains the following variables: number of samples, time between individual samples, time between groups of samples and two delay times, one for each mode switch. The algorithm compares the average value of a group of samples with the previous averaged group and if a lower voltage signal has been detected, changes the cooling mode (on to off or off to on). Further sample taking is then delayed to allow lamp 10 to respond to the change. Two time delays A and B were found to be necessary since it was found that the lamp responded much faster to the application of the cooling airflow then when the airflow is stopped. A time delay of 5 secs for "A" and 1 sec for "B" provided satisfactory results.

Figure 4:
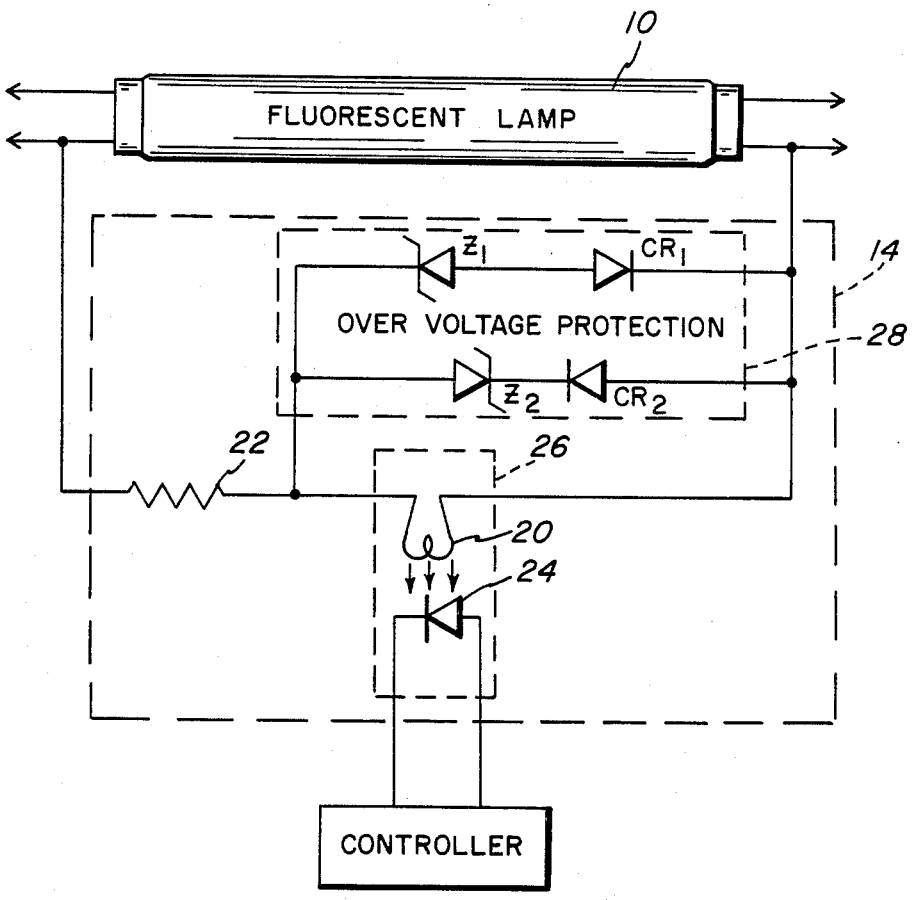
FIG. 4 is a detailed schematic of the preferred embodiment of the monitoring circuit shown in FIG. 2.

Monitoring circuit 14 may be any type of circuit utilizing known measuring and response devices. Since the lamp voltage in ac operation is a periodic function usually containing higher order frequencies than the fundamental applied voltage, an RMS (root mean square) responding voltmeter is preferred. It is also necessary to electrically isolate the lamp circuit from the particular monitoring circuit used. It would also be advantageous to transduce the ac signal to the dc potential that is a function of the true RMS of the ac signal. The particular circuit used in the present testing example is shown in FIG. 4. This circuit is preferable to conventional circuits since it provides the desired monitoring function while incorporating a simple electrical isolation mechanism. Any nonlinearity of the input voltage vs. light output of the incandescent lamp is not a problem since only the direction of change of the input voltage is required, not the absolute magnitude. In fact, the monlinearity can increase the sensitivity of the system. As shown in FIG. 4, a 12 volt miniature incandescent lamp 20 and associated voltage dropping resistor 22, are placed in parallel with lamp 10. Lamp 20 is therefore powered by a voltage proportional to the lamp 10 arc voltage. The illumination output of the incandescent lamp is then monitored by photodetector 24 thereby providing an isolated control signal at low voltage levels. The output from photodetector 24 is sent to controller 16. Lamp 20 and photodetector 24 are housed in a light-tight container 26 to block out extraneous light. Circuit 28 is an over voltage protection circuit consisting of zener diodes Z1, Z2 and signal diodes CR1, CR2. This circuit protects lamp 20 from an over voltage condition which would be created if lamp 10 failed to start.

Typical components for the circuit of FIG. 4 are as follows:

Lamp 20—GE 12 A1
Resistor 22—1400 ohms, 20 watt
$Z_1$,$Z_2$—14 v, 2 watt
$CR_1$,$CR_2$—IN 914
photodetector 24—Vactec VTB9 412

The test results using the circuit of FIG. 3 with the exemplary monitoring circuit of FIG. 4 are provide in Table I. Table I shows the resulting conditions when the ambient temperature was adjusted in steps from 60° F. to 95°. The data illustrates the degree of control of the output over a wide range of test conditions.

The foregoing description of the methods and circuits of the present invention is given by way of illustration and not of limitation. Various other embodiments may be utilized to perform the monitoring and control functions while still within the purview of the invention. For example, instead of a cooling fan, a thermoelectric (Peltier's junction) cooler could be used to control the cold spot temperature in response to signals generated in the voltage monitoring circuit.

TABLE I

| AMBIENT TEMP | CURRENT AMPS | AIR-FLOW (FPM) | +/− ILLUM ERR % | SMPLE NO. SMPLES | SMPLE SMPLE DLY | SMPLE GRP DLY | SMPLE OFF DELAY | SMPLE ON DELAY |
|---|---|---|---|---|---|---|---|---|
| 60.00 | .80 | 810 | 3.86 | 50.00 | .00 | .50 | 5.00 | 1.00 |
| 60.00 | .80 | 1180 | 3.16 | 50.00 | .00 | .50 | 7.00 | .50 |
| 60.00 | .80 | 1760 | 4.40 | 50.00 | .00 | .50 | 5.00 | 1.00 |
| 60.00 | 2.00 | 1180 | .77 | 50.00 | .00 | .50 | 5.00 | 1.00 |
| 75.00 | .80 | 810 | 1.01 | 50.00 | .00 | .50 | 5.00 | 1.00 |
| 75.00 | .80 | 1760 | 2.48 | 50.00 | .00 | .50 | 5.00 | 1.00 |
| 75.00 | 1.50 | 1760 | .93 | 50.00 | .00 | .50 | 5.00 | 1.00 |
| 75.00 | 2.00 | 810 | .75 | 50.00 | .00 | .50 | 5.00 | 1.00 |
| 75.00 | 2.00 | 1760 | .55 | 50.00 | .00 | .50 | 5.00 | 1.00 |
| 95.00 | .80 | 810 | .55 | 50.00 | .00 | .50 | 5.00 | 1.00 |
| 95.00 | .80 | 1180 | 2.27 | 50.00 | .00 | .50 | 5.00 | 1.00 |
| 95.00 | .80 | 1760 | .44 | 50.00 | .00 | .50 | 5.00 | 1.00 |
| 95.00 | 1.50 | 810 | 1.81 | 50.00 | .00 | .50 | 5.00 | 1.00 |
| 95.00 | 1.50 | 1180 | .90 | 50.00 | .00 | .50 | 5.00 | 1.00 |
| 95.00 | 1.50 | 1760 | .56 | 50.00 | .00 | .50 | 5.00 | 1.00 |
| 95.00 | 2.00 | 810 | 1.60 | 50.00 | .00 | .50 | 5.00 | 1.00 |
| 95.00 | 2.00 | 1180 | 1.06 | 50.00 | .00 | .50 | 5.00 | 1.00 |
| 95.00 | 2.00 | 1760 | .74 | 50.00 | .00 | .50 | 5.00 | 1.00 |
| 65.00 | .80 | 1180 | .87 | 50.00 | .00 | .50 | 5.00 | 1.00 |
| 60.00 | .95 | 1180 | 2.27 | 50.00 | .00 | .50 | 5.00 | 1.00 |

What is claimed is:

1. A monitoring and control mechanism for optimizing the light output of a fluorescent lamp containing an excess of mercury at a cold spot therein, said mechanism comprising:

a power supply for applying operating power to said lamp, said power supply adapted to maintain a constant operating current through said lamp resulting in a lamp arc voltage which is a function of the lamp mercury pressure, a monitoring means for detecting a decrease from a maximum lamp are voltage associated with an optimum cold spot temperature, and generating a signal indicative thereof, a temperature control device placed in proximity to said cold spot, said device, when operational, serving to provide a constant intensity output to low the temperature of the cold spot and, when non-operational, effectively permitting the cold spot temperature to rise, and a controller circuit adapted to change the operational state of said temperature control device in response to the output signals from said monitoring means.

2. The mechanism of claim 1 wherein said controller circuit is adapted to analyze the direction of voltage dropoff and to send a signal to said control device following an appropriate delay so as to reverse the state of operation of said control device.

3. The mechanism of claim 1 wherein said monitoring means includes an incandescent lamp connected in parallel with said fluorescent lamp and a photosensing device placed in proximity to said incandescent lamp, said photosensing device generating a signal proportional to said output voltage change and transmitting said signal to said temperature control device.

4. A method of optimizing the light output of a fluorescent lamp containing an excess of mercury at a cold spot thereon comprising the steps of determining the lamp arc voltage corresponding to an optimum lamp light output, monitoring the arc voltage of said lamp, modifying the temperature of said cold spot by means of a cooling device having an active (cooling) mode of operation serving to provide a constant intensity output and an inactive (inoperative) mode of operation, and generating an electrical signal responsive to a dropoff from the voltage level corresponding to said optimum lamp light output, causing the instant mode of operation of said cooling device to be changed in response to said voltage change.

* * * * *

UNITED STATES PATENT AND TRADEMARK OFFICE

CERTIFICATE OF CORRECTION

PATENT NO. : 4,533,853

DATED : August 6, 1985

INVENTOR(S) : Thomas J. Hammond et al

It is certified that error appears in the above-identified patent and that said Letters Patent are hereby corrected as shown below:

Col. 2, line 54, change "very" to --vary--.

Col. 3, line 46, delete "in".

Col. 3, line 56, change "received" to --receives--.

Col. 4, line 54, change "provide" to --provided--.

Col. 5, line 40, change "low" to --lower--.

Signed and Sealed this

*Twenty-fourth* Day of *June 1986*

[SEAL]

*Attest:*

DONALD J. QUIGG

*Attesting Officer*

*Commissioner of Patents and Trademarks*